US007731484B2

(12) United States Patent
Yamamoto et al.

(10) Patent No.: US 7,731,484 B2
(45) Date of Patent: Jun. 8, 2010

(54) VACUUM PUMP CONTROL DEVICE AND VACUUM DEVICE

(75) Inventors: Hidemi Yamamoto, Hyogo (JP); Kohji Tsuji, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 926 days.

(21) Appl. No.: 10/508,378

(22) PCT Filed: Mar. 20, 2003

(86) PCT No.: PCT/JP03/03447

§ 371 (c)(1),
(2), (4) Date: Mar. 24, 2005

(87) PCT Pub. No.: WO03/078838

PCT Pub. Date: Sep. 25, 2003

(65) Prior Publication Data

US 2005/0163622 A1 Jul. 28, 2005

(30) Foreign Application Priority Data

Mar. 20, 2002 (JP) ..... 2002-077708

(51) Int. Cl.
*F04B 49/02* (2006.01)

(52) U.S. Cl. ..... 417/27; 417/44.1; 417/44.11

(58) Field of Classification Search ..... 417/32, 417/27, 44.1, 19, 44.11, 502
See application file for complete search history.

(56) References Cited

U.S. PATENT DOCUMENTS 4,664,601 A 5/1987 Uchida et al.
6,244,825 B1 6/2001 Sasaki et al.

FOREIGN PATENT DOCUMENTS

| | | |
|---|---|---|
| JP | 58-093494 | 6/1983 |
| JP | 58-93494 | 6/1983 |
| JP | 62-102883 | 6/1987 |
| JP | 5-118289 | 5/1993 |
| JP | 5-231381 | 9/1993 |
| JP | 2000-110735 | 4/2000 |

OTHER PUBLICATIONS

Dec. 14, 2005 official Communication and Supplementary European Search Report in connection with European Appl. No. EP 03 71 2801.

*Primary Examiner*—Michael Cuff
*Assistant Examiner*—Vikansha S Dwivedi
(74) *Attorney, Agent, or Firm*—Cooper & Dunham LLP

(57) ABSTRACT

The present invention has an object of controlling power consumption by a vacuum pump by varying the number of revolutions of the vacuum pump in accordance with the operating state of a vacuum device.

The condition setting part 4 sets the relationship between the operating state of the vacuum device 10 and the rotational speed of the vacuum pump 2 that evacuates the vacuum device 10. This relationship is set to an appropriate value so as to prevent the rotational speed of the vacuum pump 2 from becoming a higher rotational speed than is required. The control part 6, to which external signals S1 through Sn corresponding to the operating state of the vacuum device 10 are input, reads out from the condition setting part 4 and outputs the rotational speed of the vacuum pump 2 corresponding to the external signals. The inverter 8 controls the rotational speed of the vacuum pump based on the output of the control part 6.

11 Claims, 6 Drawing Sheets

VACUUM PUMP CONTROL DEVICE AND VACUUM DEVICE

TECHNICAL FIELD

The present invention relates to vacuum pump controllers and vacuum devices, and particularly to control of a vacuum pump in a vacuum device that is operated continuously for a long period of time.

An example of such a vacuum device is a vacuum device used in depositing a variety of thin films on a substrate or processing a substrate in a semiconductor manufacturing process.

BACKGROUND ART

In a vacuum device used in a semiconductor manufacturing process, an etching device, a thin film deposition device, and other process chambers are connected via gates to a transfer chamber with a robot that introduces and brings out semiconductor wafers that are specimens, and load lock chambers for changing the wafers that are specimens are connected via gates to the transfer chamber. Each of the process chambers and the load lock chambers is connected to a vacuum pump via an exhaust channel with an opening and closing valve, so that both process chambers and load lock chambers as well as the transfer chamber are evacuated.

Considering, for instance, the load lock chambers, there are a variety of operating states such as a period of performing evacuation from the state of being open to the atmosphere for changing specimens, a period of wafer change by the robot, and a period of closure of the load lock chambers. In these periods, exhaust capability is controlled by the opening and closing operations of the opening and closing valves of the exhaust channels.

During the operation of such a vacuum device, if the motor of the vacuum pump is stopped in the middle of manufacturing so that the vacuum of the vacuum device cannot be maintained, products being processed become defective. Therefore, in order to avoid such a situation, the vacuum pump is controlled so as to be driven continuously and constantly. Further, its rotational speed is set so as to be always constant irrespective of the operating state of the vacuum device.

It has been proposed to reduce the number of revolutions of a motor driving a vacuum pump when the power consumption of the motor becomes higher than or equal to a predetermined value in order to protect the vacuum pump from overloading while maintaining the vacuum of a vacuum device (see Japanese Laid-Open Patent Application No. 2000-110735). It has also been proposed to urge maintenance before a vacuum pump comes to a stop by measuring a physical quantity such as case temperature or motor current values that vary during the operation of the pump and issuing an alarm when the measured value reaches a preset value (see Japanese Laid-Open Patent Application No. 5-118289).

The object of these proposals is to avoid a situation where the vacuum device cannot maintain a vacuum by protecting the vacuum pump from overloading. They have no intention to control power consumption in the vacuum pump.

When a vacuum pump is driven at a constant rotational speed, the vacuum pump may rotate at a greater number of revolutions than is required depending on the operating state of a vacuum device. The vacuum pump cannot be stopped during the operation of the vacuum device, and depending on the operating state, it is driven at a greater number of revolutions than is required, thus causing needless power consumption.

SUMMARY

In an aspect of this disclosure, power consumption by a vacuum pump is controlled by varying the number of revolutions of the vacuum pump in accordance with the operating state of a vacuum device.

In an exemplary embodiment of this disclosure, the operating state of a vacuum device is determined based on not the current values of a motor driving a vacuum pump, but external signals from the opening and closing valves of exhaust channels for maintaining the vacuum of the vacuum device at a predetermined state. The vacuum pump is controlled to a preset appropriate rotational speed in accordance with the determined operating state so as to avoid driving the vacuum pump at a greater number of revolutions than is required, thereby controlling power consumption. Here, the external signals mean signals generated from other than the vacuum pump.

The outline of a vacuum device and a vacuum device controller of the present invention is shown in FIG. 1. A condition setting part 4 sets the relationship between the operating state of a vacuum device 10 and the rotational speed of a vacuum pump 2 evacuating the vacuum device 10. This relationship is set to an appropriate value so that the rotational speed of the vacuum pump 2 is prevented from being a higher rotational speed than is required. External signals such as signals S1 through Sn from opening and closing valves corresponding to the operating state of the vacuum device 10 are input to a control part 6, which reads out the rotational speed of the vacuum pump 2 corresponding to the external signals from the condition setting part 4, and outputs it. An inverter 8 controls the rotational speed of the vacuum pump based on the output of the control part 6.

The vacuum device 10 of the present invention has the vacuum pump 2 controlled by that controller 6.

In the present invention, the control part 6 determines the operating state of the vacuum device 10 from the external signals such as S1 through Sn, calls a set rotational speed from the condition setting part 4 in accordance with it, and controls the rotation of the vacuum pump 2 via the inverter 8 so that the rotational speed of the vacuum pump 2 becomes the set rotational speed. Accordingly, by setting conditions in the condition setting part 4 so as to control power consumption, needless power consumption by the vacuum pump 2 can be suppressed.

BEST MODE FOR CARRYING OUT THE INVENTION

A vacuum device to which the present invention is directed has multiple exhaust channels with opening and closing valves to a vacuum pump. In this case, external signals include signals controlling the opening and closing valves.

Another vacuum device to which the present invention is directed has multiple exhaust channels with opening and closing valves to a vacuum pump, and each opening and closing valve has a sensor detecting its opening and closing state. In this case, external signals may include signals from the sensors.

The states of the opening and closing valves of the multiple exhaust channels represent the operating state of the vacuum device. Accordingly, the operating state of the vacuum device can be determined from signals obtained in relation to the opening and closing operations of these opening and closing valves, and by controlling the number of revolutions of the vacuum pump as set based on it, power consumption can be controlled.

Preferably, a control part can also select a direct transfer operation mode to rotate the vacuum pump at a predetermined constant speed without intervention by an inverter so as to be able to control the vacuum pump without intervention by the inverter in the case of inverter failure or under conditions unsuitable for controlling the vacuum pump through the inverter even when the vacuum pump controller has the inverter.

The direct transfer operation mode may be selected when power is turned on or a signal from the inverter or an internal control circuit reaches a predetermined condition.

Embodiments

Figure 2:
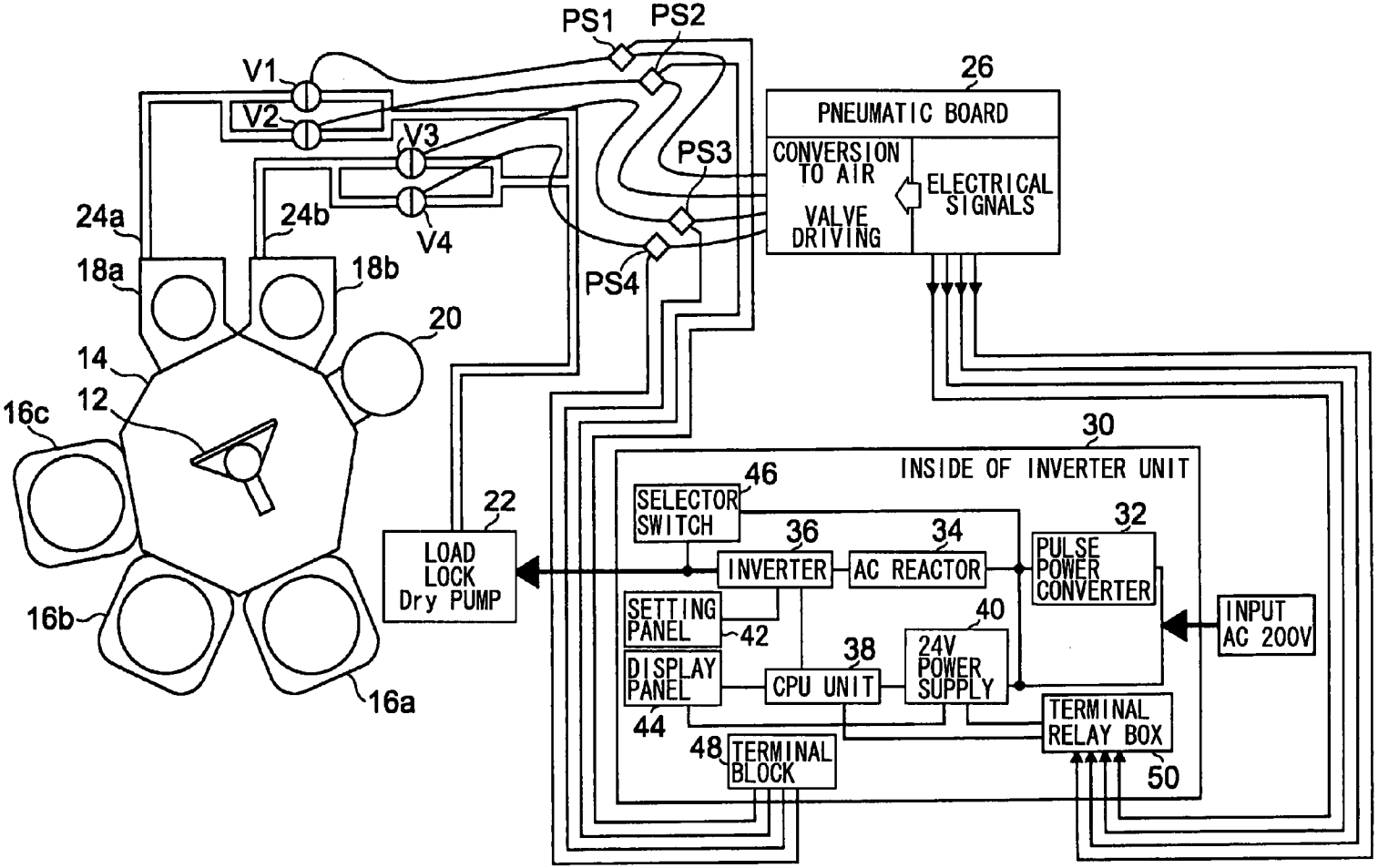
FIG. 2 is a schematic diagram showing an embodiment of the present invention.

FIG. 2 shows a first embodiment in which the present invention is applied to a controller controlling the vacuum pump of load lock chambers for bringing semiconductor wafers in and out of processing devices in a semiconductor manufacturing device.

Multiple process chambers 16*a* through 16*c* performing processing such as thin film deposition and etching are connected to a transfer chamber (also called a handling module) 14 with a robot 12 that changes wafers. Further, load lock chambers 18a and 18*b* are also connected to the transfer chamber 14 in order to introduce wafers to be processed from outside and bring out processed wafers. Since the processed wafers have high temperatures, a cooling chamber 20 is provided to cool the wafers. Interfaces such as gate valve mechanisms that are openable and closable and can be closed to maintain air tightness are provided between the process chambers 16*a* through 16*c*, the cooling chamber and the load lock chambers 18*a* and 18*b* and the transfer chamber 14. An exhaust channel connected to a vacuum pump is provided to each of the process chambers 16*a* through 16*c* and the load lock chambers 18*a* and 18*b*.

In this embodiment, a controller is shown that determines the operating states of the load lock chambers 18*a* and 18*b* as vacuum devices based on the states of opening and closing valves V1 through V4 provided to the exhaust channels of the load lock chambers 18*a* and 18*b*, and controls the rotational speed of a load lock dry pump 22 connected to the exhaust channels.

The load lock chambers 18*a* and 18*b* and the pump 22 are connected by exhaust channels 24*a* and 24*b*, respectively. The exhaust channels 24*a* and 24*b* each branch into two exhaust channels so that their exhaust capability can be controlled by opening and closing the opening and closing valves V1 through V4 provided to their respective branch exhaust channels. Of the inside diameters of the two branch exhaust channels of the exhaust channel 24*a*, that of the exhaust channel to which the opening and closing valve V2 is provided is greater than that of the exhaust channel to which the opening and closing valve V1 is provided, so that the exhaust channel to which the opening and closing valve V2 is provided has a greater exhaust capability. With respect to the exhaust channel 24*b*, the exhaust channel to which the opening and closing valve V4 is provided is greater in inside diameter than the exhaust channel to which the opening and closing valve V3 is provided, so that the exhaust channel to which the opening and closing valve V4 is provided has a greater exhaust capability.

The opening and closing operations of the opening and closing valves V1 through V4 are controlled by air pressures sent via pipes from a pneumatic board 26. Pressure switches PS1 through PS4 are provided to the corresponding pipes. The detection signals of the pressure switches PS1 through PS4 may become external signals so as to be used to detect the opening and closing states of the valves V1 through V4.

Control signals for sending air pressures via the pipes are generated from the pneumatic board 26. The electrical signals may also become external signals so as to be used to detect the opening and closing states of the valves V1 through V4.

An inverter unit 30, which is a controller of the pump 22, includes an inverter 36 and a CPU unit 38, which is a control part, as principal mechanisms. The inverter 36 supplies driving power to the motor of the pump 22 so as to rotate the motor, and also controls the rotational speed of the pump 22 variably by varying the frequency of the driving power by an input signal so as to vary the number of revolutions of the motor. An input power supply of AC 200 V has harmonic components removed in an AC reactor 34 to be supplied to the inverter 36. The inverter 36 makes it into a driving power supply of a predetermined frequency based on an instruction from the CPU unit 38, and supplies it to the pump 22. A pulse power converter 32 converts the power supplied to the pump 22 into power consumption.

The relationship between the operating state of the vacuum device and the rotational speed of the vacuum pump is set in the CPU unit 38 from a setting panel 42. The set conditions are displayed on a display panel 44.

A selector switch 46 performs switching, based on an instruction from the CPU unit 38, between driving the pump 22 through the inverter 36 and the direct transfer operation mode that drives it at a constant frequency without intervention by the inverter 36.

A power supply circuit 40, which makes a DC power supply of 24 V from the AC power supply of 200 V, supplies DC 24 V to the CPU unit 38.

In order to detect the operating states of the load lock chambers 18*a* and 18*b*, a terminal block 48 taking the detection signals of the pressure switches PS1 through PS4 of the pipes driving the opening and closing valves V1 through V4 as external signals is provided. The external signals taken by the terminal block 48 are supplied to the CPU unit 38.

As another method for detecting the operating states of the load lock chambers 18*a* and 18*b*, opening and closing valve driving electrical signals output outside from the pneumatic board 26 are taken into the CPU unit 38 via a terminal relay box 50 inside the inverter unit 30.

Figure 1:
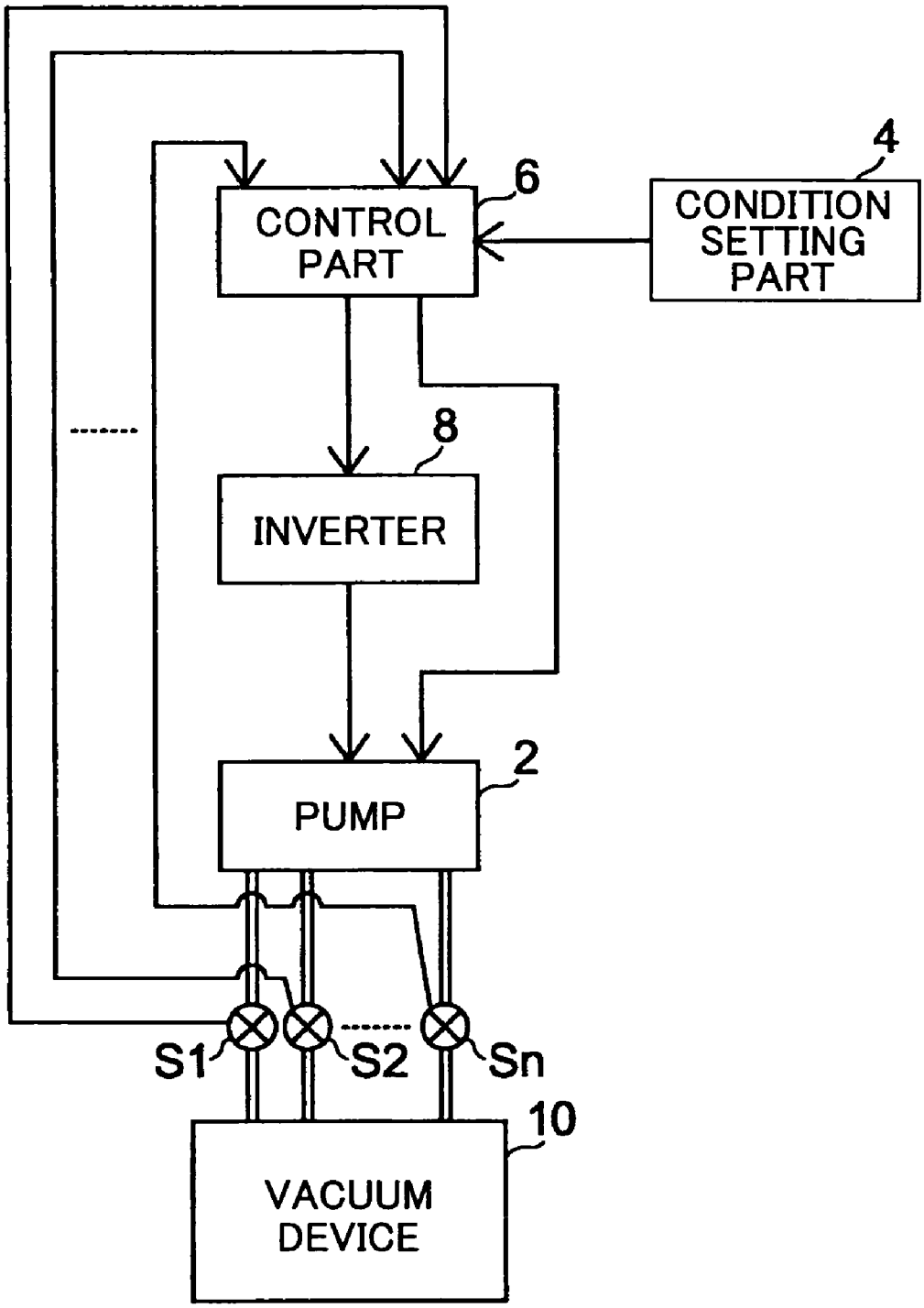
FIG. 1 is a block diagram showing the outline of a vacuum device and a vacuum pump controller according to embodiments of the present invention.

The CPU unit 38 and the display panel 44 realize the control part 6 and the condition setting part 4 of FIG. 1. The inverter 8, the pump 2, and the vacuum device 10 in FIG. 1 correspond to the inverter 36, the pump 22, and the load lock chambers 18*a* and 18*b*, respectively. The external signals S1 through Sn in FIG. 1 correspond to the detection signals of the pressure switches PS1 through PS4 and the opening and closing valve driving electrical signals output from the pneumatic board 26.

A description is given of the operations of the load lock chambers 18*a* and 18*b* in this embodiment. A description is given of the load lock chamber 18*a*. In the case of performing an evacuation from the atmospheric state, first, a rough evacuation is performed with the opening and closing valve V1 being opened and the opening and closing valve V2 being closed. When a certain degree of vacuum is reached, the opening and closing valve V1 is closed and the opening and closing valve V2 is opened so that an evacuation is performed until a set degree of vacuum. After the evacuation is completed, the opening and closing valve v2 is also closed so that the vacuum is maintained. If the degree of vacuum of the load lock chamber deviates off the set degree of vacuum during wafer processing, the opening and closing valve V2 is reopened so that an evacuation is performed until the set degree of vacuum. Likewise, with respect to the load lock chamber 18*b*, the opening and closing valve V4 is closed and the opening and closing valve V3 is opened in a rough evacuation from the atmospheric state. Then, the opening and closing valve V3 is closed and the opening and closing valve V4 is opened in an evacuation after a set degree of vacuum. After the evacuation is completed, the opening and closing valve V4 is also closed so that the vacuum is maintained.

In the case of using both load lock chambers 18*a* and 18*b* simultaneously, the rough evacuation is started at the same time. Meanwhile, with respect to the evacuation, after the evacuation of one of the load lock chambers is completed, the evacuation of the other one of the load lock chambers is started.

The state where the evacuation is completed and all the opening and closing valves are closed becomes an idling state, but the pump 22 continues to rotate.

The inverter unit 30 detects the opening and closing states of the opening and closing valves V1 through V4 from the detection signals of the pressure switches PS1 through PS4 or the electrical signals from the pneumatic board 26, and controls the rotational speed of the pump 22 in accordance with their opening and closing states. For instance, at the time of idling when all the opening and closing valves V1 through V4 are closed, the inverter 36 operates the pump 22 at low-speed rotation at a number of revolutions of 30 Hz. When at least one of the opening and closing valves V1 through V4 is opened, the inverter 36 increases the number of rotations of the pump 22 from 30 Hz to 50 Hz or 60 Hz so as to operate it at high-speed rotation.

Figure 3:
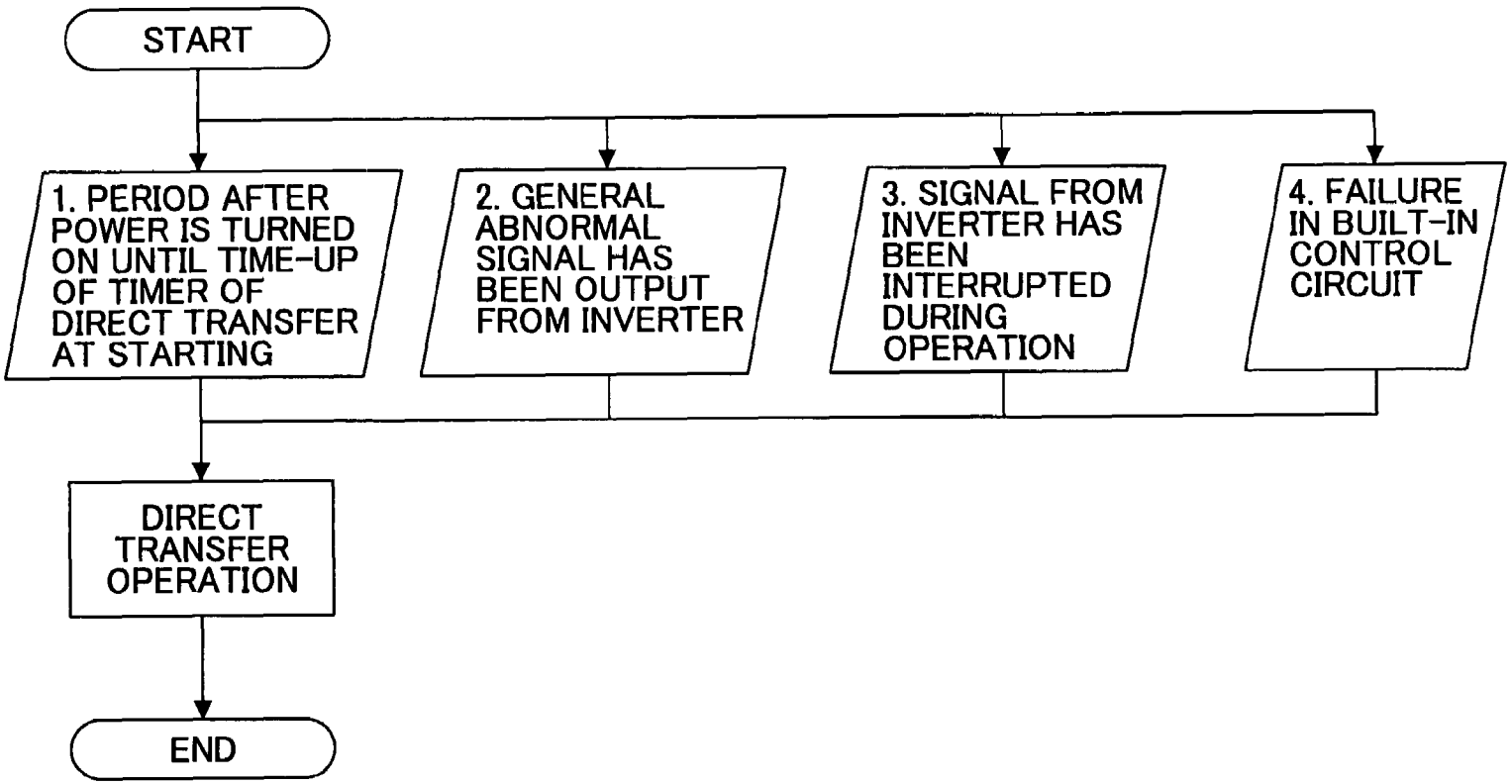
FIG. 3 is a flowchart showing the operation of switching between driving through an inverter and a direct transfer operation mode without intervention by the inverter in this embodiment.

This embodiment is provided with the direct transfer operation mode so that the pump 22 continues to operate even when an abnormality occurs in the inverter unit. FIG. 3 shows the operation of switching between driving through the inverter and the direct transfer operation mode without intervention by the inverter. Here, settings are provided in the CPU unit 38 so that the direct transfer operation mode is entered without intervention by the inverter in the following four conditions (1) through (4).

(1) A period until a predetermined time at the time of starting. That is, a period after power is turned on until a built-in control circuit starts up normally after self-diagnosis or until the activation of the motor of the pump is completed. This is because the inverter may not operate normally during this period.

(2) When a general abnormal signal is output from the inverter because of overloading.

(3) When feedback from the inverter is interrupted during an operation by the inverter.

(4) When a failure in the built-in control circuit occurs, such as an abnormality in a DC power supply for driving the control circuit or a failure in a sequencer that is the center of the control circuit.

(2) through (4) are abnormalities during operations, and may affect control by the inverter. Accordingly, in these cases, switching is performed immediately to the direct transfer operation mode at 50 Hz or 60 Hz.

Figure 4A:
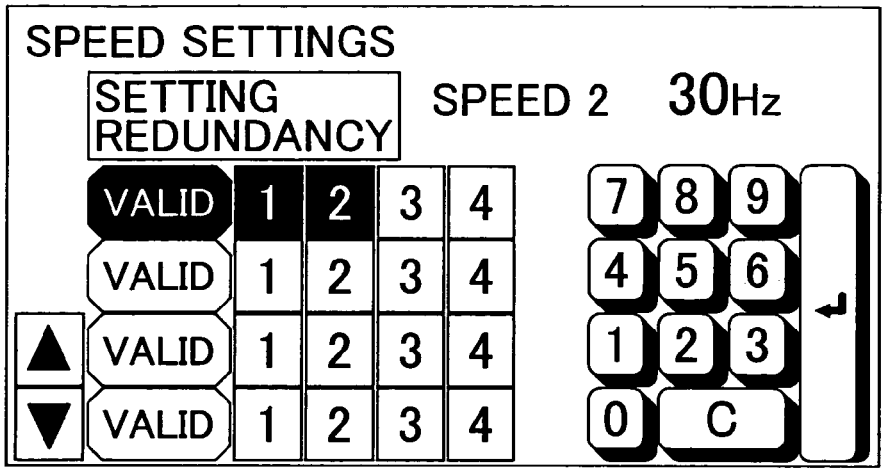
In FIG. 4, (A) is a diagram showing a setting panel for setting conditions, and (B) is a diagram showing a setting panel for providing timer settings at the time of switching operation modes.

FIG. 4A shows an example of the setting panel 42 setting conditions in the condition setting part. Here, the four driving electrical signals from the pressure switches PS1 through PS4 related to the four opening and closing valves V1 through V4 or the pneumatic board 26 are displayed as signals of numbers 1, 2, 3, and 4 of four channels. Based on a combination of the four signals, it is determined what Hz the rotational speed of the pump 22 is to be set to. The graphically represented case shows as a general example that it is set to 30 Hz that is Rotational Speed 2 when the signals 1 and 2 of two channels are input.

Figure 4B:
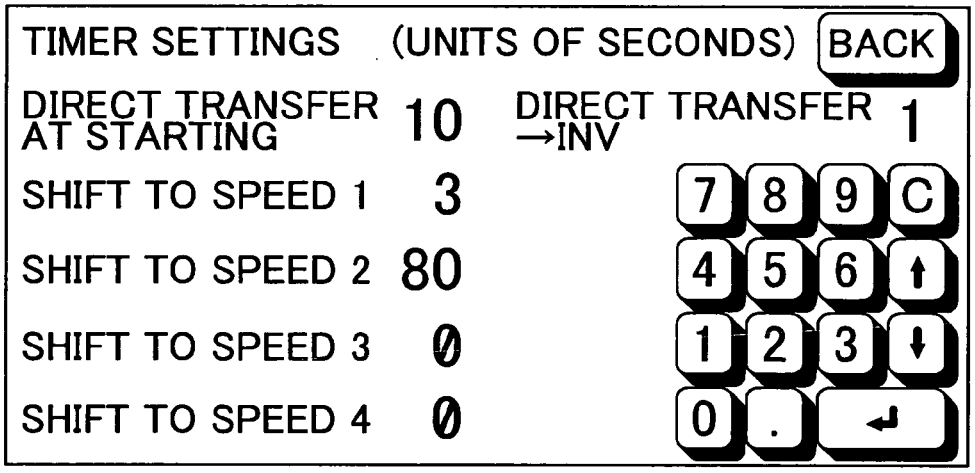

FIG. 4B shows an example of the setting panel 42 providing timer settings at the time of switching an operation mode. Here, it is shown that four speed levels can be set in addition to the direct transfer operation mode at 50 Hz or 60 Hz. In the CPU unit 38, it is determined from the four external input signals which set rotational speed to shift to. After a shift wait time set by the timer settings, switching to the rotational speed is performed. Suppose that Speed 1 is set to 60 Hz and Speed 2 is set to 30 Hz, for instance. In this case, after performing the direction transfer operation mode for 10 seconds at the time of starting, it is switched to an inverter-mode operation.

Figure 5:
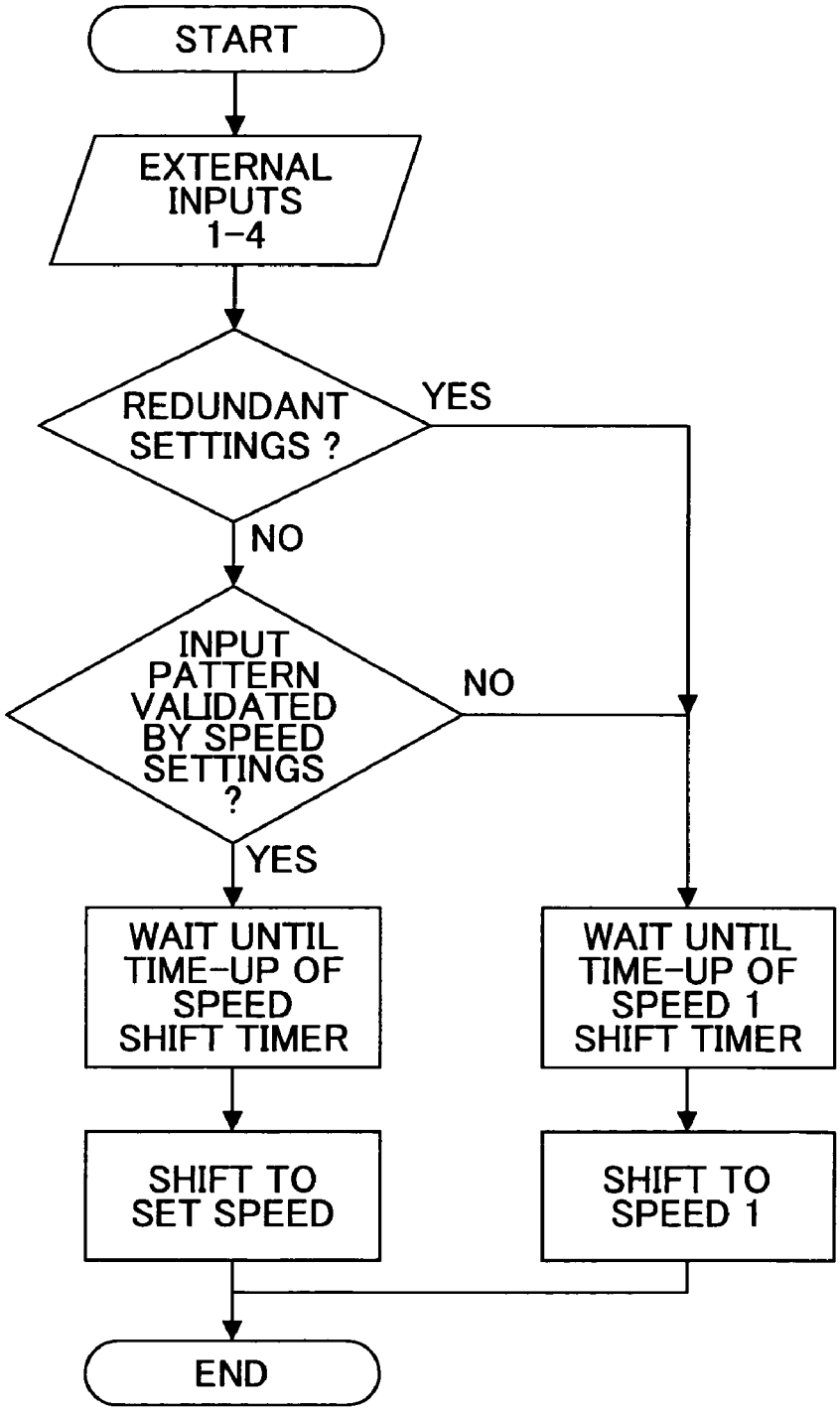
FIG. 5 is a flowchart showing an operation at the time of shifting rotational speed during an inverter mode operation.

An operation at the time of shifting rotational speed during the inverter-mode operation in the case where settings are provided as in FIGS. 4A and 4B is shown in FIG. 5.

External input signals 1 through 4 are taken in, and it is determined whether the combination of the signals has been set. If the combination of the external input signals 1 through 4 is an input other than those set, or if there is a redundancy in the settings themselves, a forcible shift is made to Speed 1 after 3 seconds. If the combination of the external input signals 1 through 4 is a set input, a shift is made to the set rotational speed after a period of time set by a timer. For instance, if the external input signals 1 and 2 are input simultaneously, it becomes 30 Hz of Speed 2 after 80 seconds. In the case of the other inputs (including no input), it becomes 60 Hz of Speed 1 after three seconds.

Figure 6:
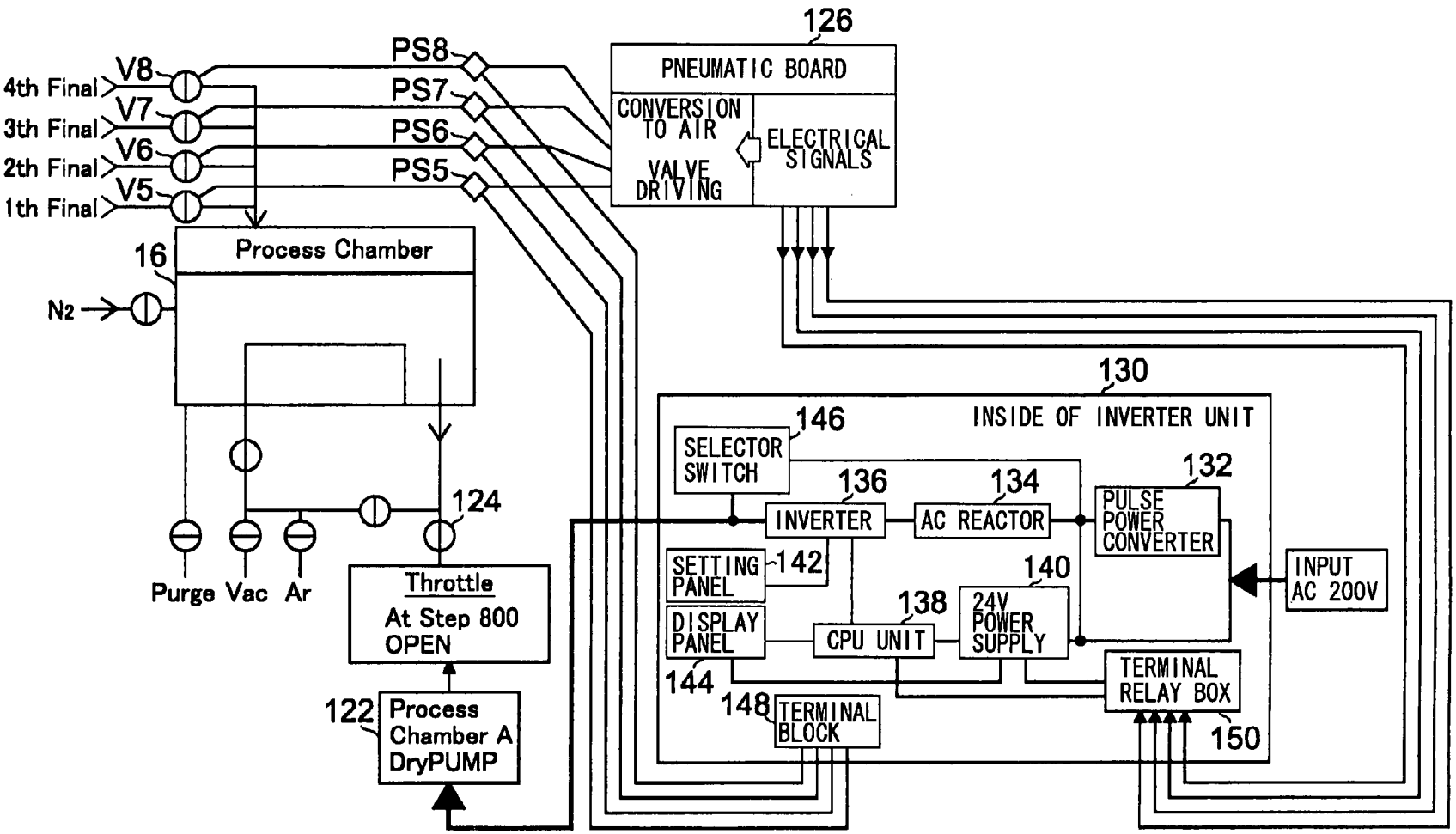
FIG. 6 is a schematic diagram showing another embodiment.

FIG. 6 shows a second embodiment in which the present invention is applied to a controller controlling a vacuum pump that evacuates one process chamber 16 in the semiconductor manufacturing device of FIG. 2. The same pump and controller as shown in FIG. 6 are provided to all the process chambers 16*a* through 16*c* in the semiconductor manufacturing device of FIG. 2.

An exhaust channel connected to a process chamber dry pump 122 is provided to evacuate the process chamber 16. A throttle valve 124 for APC (auto process control) for controlling exhaust capacity is provided to the exhaust channel. The degree of vacuum of the process chamber 16 can be controlled by the opening of the throttle valve 124.

Four types of process gases are introduced to the process chamber 16. Four opening and closing valves V5 through V8 connected to the process chamber 16 are opening and closing valves at the final stage of the process gas introduction channels. This embodiment is a controller that determines the operating state of the process chamber 16 as a vacuum device and controls the rotational speed of the dry pump 122 based on the states of the opening and closing valves V5 through V8.

The opening and closing operations of the opening and closing valves V5 through V8 are controlled by air pressures sent via pipes from a pneumatic board 126. Pressure switches PS5 through PS8 are provided to the corresponding pipes. The detection signals of the pressure switches PS5 through PS8 may become external signals so as to be used to detect the opening and closing states of the valves V5 through V8.

Control signals for sending air pressures via the pipes are generated from the pneumatic board 126. The electrical signals may also become external signals so as to be used to detect the opening and closing states of the valves V5 through V8.

An inverter unit 130, which is a controller of the pump 122, has the same configuration as the inverter unit 30 in the embodiment of FIG. 2. Therefore, the internal mechanisms or functions are referred to by changing the reference numerals of the counterparts of the inverter unit 30 to corresponding one hundreds, thereby showing that they have the same contents, and a description thereof is omitted.

The correspondence to the parts of FIG. 1 is the same as in the embodiment of FIG. 2.

A description is given of the operation of the process chamber 16 in this embodiment. The process chamber 16 is evacuated to a high vacuum after a purge and cleaning. Thereafter, switching to the process chamber dry pump 122 is performed. In a processing process, a predetermined one of the valves V5 through V8 is opened so that a predetermined process gas is introduced into the process chamber 16. The opening of the throttle valve 124 is controlled so that a process gas pressure inside the process chamber 16 is controlled. Then, a predetermined process is started.

This embodiment controls the rotational speed of the dry pump 122 based on the opening and closing states of the valves V5 through V8.

Settings are provided in a CPU unit 138 so as to operate the pump 122 at low-speed rotation at a number of revolutions of 30 Hz when all the opening and closing valves V5 through V8 are closed and to operate the pump 122 at high-speed rotation at a number of revolutions of 60 Hz (or 50 Hz) when any of the opening and closing valves V5 through V8 is open.

In this embodiment, the direct transfer operation mode is also provided so that the pump 122 continues to operate even when an abnormality occurs in the inverter unit 130 as shown in FIG. 3.

Condition settings and timer settings are provided to the CPU unit 138 in the same manner as described with FIGS. 4(A) and (B). In this case, the settings are provided so as to operate the pump 122 at low-speed rotation a number of revolutions of 30 Hz when all the opening and closing valves V5 through V8 are closed and to operate the pump 122 at high-speed rotation at a number of revolutions of 60 Hz (or 50 Hz) when any of the opening and closing valves V5 through V8 is open.

An operation at the time of shifting rotational speed during the inverter-mode operation is the same as that shown in FIG. 5. The state where an evacuation by which the process chamber 16 has been evacuated to a high vacuum is completed, switching to the dry pump 122 has been performed, and all the opening and closing valves V5 through V8 are closed is an idling state. At the time of idling, the inverter 136 operates the pump 122 at low-speed rotation at a number of revolutions of 30 Hz. When at least one of the opening and closing valves V5 through V8 is open, the inverter 136 increases the number of revolutions of the pump 122 from 30 Hz to 60 Hz (or 50 Hz) so as to operate it at high-speed rotation.

Instead of being fixed at 60 Hz (50 Hz), the number of revolutions of the pump 122 during processing may be reduced to that of a lower speed. When the degree of vacuum of the process chamber 16 is controlled by APC by the throttle valve 124 as in this embodiment, the number of revolutions of the pump 122 may be reduced within a range where pressure is controllable by APC.

The vacuum device to which the present invention is directed is not limited to the semiconductor manufacturing process devices shown in the embodiments. Application of the present invention in a device that operates a vacuum pump continuously for a long period of time can suppress needless power consumption.

Further, by displaying the effect of suppressing needless power consumption according to the present invention as the amount of money per month or in terms of the effect of carbon dioxide reduction, the effect of power consumption reduction can be understood intuitively.

INDUSTRIAL APPLICABILITY

Thus, according to the embodiments of the present invention, the relationship between the operating state of a vacuum device and the rotational speed of a vacuum pump that evacuates the vacuum device is preset, while the rotational speed of the vacuum pump is controlled by an inverter by inputting external signals corresponding to the operating state of the vacuum device and reading out the rotational speed of the vacuum pump corresponding to the external signals from set conditions. Accordingly, it is possible to control the rotational speed of the vacuum pump so as to control power consumption.

The operating state of the vacuum device can be determined easily using signals controlling the opening and closing valves of multiple exhaust channels provided to the vacuum device as the external signals in order to detect the operating state of the vacuum device.

If the opening and closing valves of the exhaust channels have sensors detecting opening and closing states, the operating state of the vacuum device can also be determined easily using signals from the sensors as the external signals.

If a direct transfer operation mode that rotates the vacuum pump at a predetermined constant speed without intervention by the inverter is selectable, stoppage of the vacuum pump can be avoided even in the case of inverter failure or under conditions unsuitable for controlling the vacuum pump via the inverter.

A vacuum device with a vacuum pump to which a controller according to the present invention is provided can suppress needless power consumption due to unnecessary high-speed rotation of the vacuum pump.

The invention claimed is:

1. A vacuum pump controller for a vacuum pump that evacuates a vacuum device, comprising:

a condition setting part configured to preset a relationship between a plurality of combinations of opening or closing states of a plurality of valves and corresponding values of a rotational speed of the vacuum pump, the valves being provided to corresponding exhaust channels between the vacuum device and the vacuum pump;

a control part configured to receive external signals indicating the opening or closing states of the valves, and to read out from the condition setting part and output one of the values of the rotational speed of the vacuum pump corresponding in the preset relationship to one of the combinations of the opening or closing states of the valves corresponding to the external signals; and an inverter configured to control the rotational speed of the vacuum pump to the one of the values output from the control part based on the preset relationship.

2. The vacuum pump controller as claimed in claim 1, wherein the control part is capable of selecting a direct transfer operation mode that rotates the vacuum pump at a predetermined constant speed without intervention by the inverter.

3. The vacuum pump controller as claimed in claim 2, wherein the control part selects the direct transfer operation mode when power is turned on.

4. The vacuum pump controller as claimed in claim 2 or 3, wherein signals are also input to the control part from the inverter and an internal control circuit, and the control part also selects the direct transfer operation mode when the signals reach preset conditions.

5. The vacuum pump controller as claimed in claim 1, wherein said control part is responsive to the external signals, including the signals from the sensors detecting the opening and closing of the one or more valves provided to the plurality of exhaust channels between the vacuum device and the vacuum pump, or the signals controlling the one or more valves, and the control part refers to said condition setting part and determines, based on the external signals, an appropriate rotational speed setting, and outputs the rotational speed setting to said inverter to control the rotational speed of the vacuum pump.

6. The vacuum pump controller as claimed in claim 1, wherein the external signals include signals from sensors detecting the opening or closing states of the valves or signals controlling opening and closing of the valves.

7. A vacuum device that has a plurality of exhaust channels with opening and closing valves to a vacuum pump, and is evacuated by the vacuum pump, characterized in that the vacuum pump includes a vacuum pump controller, the vacuum pump controller comprising:

a condition setting part configured to preset a relationship between a plurality of combinations of opening or closing states of a plurality of valves and corresponding values of a rotational speed of the vacuum pump, the valves being provided to corresponding exhaust channels between the vacuum device and the vacuum pump;

a control part configured to receive external signals indicating the opening or closing states of the valves, and to read out from the condition setting part and output one of the values of the rotational speed of the vacuum pump corresponding in the preset relationship to one of the combinations of the opening or closing states of the valves corresponding to the external signals; and an inverter configured to control the rotational speed of the vacuum pump to the one of the values output from the control part based on the preset relationship.

8. The vacuum device as claimed in claim 7, wherein the control part is capable of selecting a direct transfer operation mode that rotates the vacuum pump at a predetermined constant speed without intervention by the inverter.

9. The vacuum device as claimed in claim 8, wherein the control part selects the direct transfer operation mode when power is turned on.

10. The vacuum device as claimed in claim 8, wherein signals are also input to the control part from the inverter and an internal control circuit, and the control part also selects the direct transfer operation mode when the signals reach preset conditions.

11. The vacuum device as claimed in claim 7, wherein the external signals include signals from sensors detecting the opening or closing states of the valves or signals controlling opening and closing of the valves.

* * * * *